US008866690B2

(12) United States Patent
Lee et al.

(10) Patent No.: US 8,866,690 B2
(45) Date of Patent: Oct. 21, 2014

(54) ANTENNA SUITABLE IN HAND-HELD DEVICE

(75) Inventors: Yu-Lung Lee, Nanjhuang Township, Miaoli County (TW); Chun Chuan Chen, Xinzhuang (TW)

(73) Assignee: Powertech Industrial Co., Ltd., New Taipei (TW)

( * ) Notice: Subject to any disclaimer, the term of this patent is extended or adjusted under 35 U.S.C. 154(b) by 772 days.

(21) Appl. No.: 12/564,173

(22) Filed: Sep. 22, 2009

(65) Prior Publication Data

US 2010/0328180 A1 Dec. 30, 2010

(30) Foreign Application Priority Data

Jun. 29, 2009 (TW) ..... 98121784 A

(51) Int. Cl.

| | |
|---|---|
| ***H01Q 1/38*** | (2006.01) |
| ***H01Q 5/01*** | (2006.01) |
| ***H01Q 9/27*** | (2006.01) |
| ***H01Q 5/00*** | (2006.01) |

(52) U.S. Cl.

CPC ..... *H01Q 9/27* (2013.01); *H01Q 5/0017* (2013.01); *H01Q 5/0034* (2013.01)

USPC ..... 343/828; 343/741; 343/749

(58) Field of Classification Search

USPC ..... 343/702, 741–744, 748, 866, 867, 749, 343/828, 829, 895

See application file for complete search history.

(56) References Cited

U.S. PATENT DOCUMENTS

| | | | | |
|---|---|---|---|---|
| 6,693,594 | B2 * | 2/2004 | Pankinaho et al. | 343/700 MS |
| 6,842,158 | B2 * | 1/2005 | Jo et al. | 343/895 |
| 6,853,341 | B1 * | 2/2005 | Hellgren et al. | 343/742 |
| 7,265,729 | B1 * | 9/2007 | Chang et al. | 343/795 |
| 2004/0189530 | A1 | 9/2004 | Chung | |
| 2008/0246664 | A1 | 10/2008 | Ikemoto et al. | |

FOREIGN PATENT DOCUMENTS

| | | |
|---|---|---|
| TW | 578328 | 3/2004 |
| TW | 200419843 A | 3/2004 |

* cited by examiner

*Primary Examiner* — Michael C Wimer

(74) *Attorney, Agent, or Firm* — Houtteman Law LLC

(57) ABSTRACT

This invention provides an antenna structure, especially relates to an antenna structure in hand-held device. The antenna structure of the present invention is formed by a continue transmission line, and forming an annular shape. It is featured that the antenna structure has two end points, the first end point is a floating point, and the second end point connected to a ground. A signal input point is connected to the continue transmission line for inputting an antenna signal into the antenna structure. The signal input point keeps two-thirds of wavelength distance from the second end point. According to present invention, a small antenna structure is provided and fitting in with operation in ultra wide bandwidth frequency, furthermore the multi-frequency signal can be transceived. The antenna structure has lower signal intensity of high order harmonic signals, therefore the structure can reduce the antenna signal interferences with the high order harmonic signals.

7 Claims, 9 Drawing Sheets

| No. | frequency (MHz) | Reading (dBm) | Correction Factor (dB) | Result (dBm) | Limit (dBm) | Margin (dB) | Azimuth (°) | Height (cm) | Remark |
|---|---|---|---|---|---|---|---|---|---|
| 1 | 57.16 | -53.02 | -15.80 | -68.82 | -54.00 | -14.82 | 35.40 | 230.00 | Peak |
| 2 | 110.51 | -63.57 | -15.65 | -79.22 | -54.00 | -25.22 | 126.80 | 230.00 | Peak |
| 3 | 188.11 | -65.38 | -14.55 | -79.93 | -54.00 | -25.93 | 292.30 | 230.00 | Peak |
| 4 | 370.47 | -66.42 | -11.91 | -78.33 | -36.00 | -42.33 | 63.80 | 230.00 | Peak |
| 5 | 755.56 | -69.61 | -5.11 | -74.72 | -54.00 | -20.72 | 250.30 | 230.00 | Peak |
| 6 | 868.08 | -50.79 | -3.62 | -54.41 | -36.00 | -18.41 | 255.10 | 230.00 | Peak |

| No. | frequency (MHz) | Reading (dBm) | Correction Factor (dB) | Result (dBm) | Limit (dBm) | Margin (dB) | Azimuth (°) | Height (cm) | Remark |
|---|---|---|---|---|---|---|---|---|---|
| 1 | 45.52 | -63.83 | -11.85 | -75.68 | -36.00 | -39.68 | 217.90 | 230.00 | Peak |
| 2 | 57.16 | -61.17 | -15.33 | -76.50 | -54.00 | -22.50 | 110.20 | 230.00 | Peak |
| 3 | 86.26 | -60.43 | -21.33 | -81.75 | -36.00 | -45.75 | 357.20 | 230.00 | Peak |
| 4 | 147.37 | -67.00 | -13.25 | -80.25 | -36.00 | -44.25 | 105.30 | 230.00 | Peak |
| 5 | 766.23 | -69.26 | -4.73 | -73.99 | -54.00 | -19.99 | 335.80 | 230.00 | Peak |
| 6 | 868.08 | -47.65 | -3.64 | -51.29 | -36.00 | -15.29 | 92.10 | 230.00 | Peak |

| No. | frequency (MHz) | Reading (dBm) | Correction Factor (dB) | Result (dBm) | Limit (dBm) | Margin (dB) | Azimuth (°) | Height (cm) | Remark |
|---|---|---|---|---|---|---|---|---|---|
| 1 | 1301.00 | -54.37 | 0.74 | -53.63 | -30.00 | -23.63 | 287.30 | 230.00 | Peak |
| 2 | 1735.00 | -51.52 | 1.66 | -49.86 | -30.00 | -19.86 | 72.40 | 230.00 | Peak |
| 3 | 2169.00 | -58.68 | 2.85 | -55.84 | -30.00 | -25.84 | 354.00 | 230.00 | Peak |
| 4 | 2603.00 | -60.68 | 5.11 | -55.56 | -30.00 | -25.56 | 159.60 | 230.00 | Peak |
| 5 | 3905.00 | -60.14 | 8.46 | -51.68 | -30.00 | -21.68 | 47.70 | 230.00 | Peak |
| 6 | 4339.00 | -57.75 | 8.69 | -49.06 | -30.00 | -19.06 | 10.40 | 230.00 | Peak |
| 7 | 4773.00 | -56.30 | 8.72 | -47.58 | -30.00 | -17.58 | 179.50 | 230.00 | Peak |
| 8 | 5207.00 | -60.57 | 8.55 | -52.02 | -30.00 | -22.02 | 192.60 | 230.00 | Peak |

| No. | frequency (MHz) | Reading (dBm) | Correction Factor (dB) | Result (dBm) | Limit (dBm) | Margin (dB) | Azimuth (°) | Height (cm) | Remark |
|---|---|---|---|---|---|---|---|---|---|
| 1 | 1301.00 | -49.94 | 0.74 | -49.20 | -30.00 | -19.20 | 88.50 | 230.00 | Peak |
| 2 | 1735.00 | -51.41 | 1.72 | -49.69 | -30.00 | -19.69 | 63.40 | 230.00 | Peak |
| 3 | 2169.00 | -52.70 | 2.97 | -49.73 | -30.00 | -19.73 | 71.00 | 230.00 | Peak |
| 4 | 2603.00 | -57.12 | 5.06 | -52.07 | -30.00 | -22.07 | 71.00 | 230.00 | Peak |
| 5 | 2995.00 | -61.27 | 5.58 | -55.69 | -30.00 | -25.69 | 52.60 | 230.00 | Peak |
| 6 | 4339.00 | -51.52 | 7.76 | -43.76 | -30.00 | -13.76 | 194.70 | 230.00 | Peak |
| 7 | 4773.00 | -57.49 | 9.04 | -48.45 | -30.00 | -18.45 | 118.40 | 230.00 | Peak |

ANTENNA SUITABLE IN HAND-HELD DEVICE

CROSS-REFERENCE TO RELATED APPLICATION

This application claims priority under 35 U.S.C. §119 to Taiwan Patent Application No. 098121784, filed on Jun. 29, 2009, in the Taiwan Intellectual Property Office, the entire contents of which are hereby incorporated by reference.

BACKGROUND OF THE INVENTION

1. Field of the Invention

The present invention relates to an antenna, more specifically relates to an antenna suitable in hand-held device.

2. Description of Related Art

Development of a variety of high-tech electronic products is to facilitate people's lives, including a variety of electronic devices, such as notebook computers, mobile phones, personal digital assistants and so on. With the popularity and the increment or people's desires for high-tech electronic products, the configuration of the functions and applications of these high-tech electronic products are substantially increasing, especially the wireless communication function is widespread for the people's mobile devices. Thus, people can use these high-tech electronic products with wireless communication function in any location and at any time to get benefit of using flexible and convenient high-tech products. In view of the foregoing advantages, the location will not be the limitation for people to use the electronic products no longer, and the applications of these electronic products truly facilitate people's lives.

Since the applications of these electronic products increase, people have wider requirements to various applications, especially using these electronic products in a variety of frequency bandwidth. So that, dual-band or tri-band antenna structure usually sets up in these electronic products to be used to transceive and receive in a variety of frequency bandwidth. In order to have good transceiving and receiving signals in different environments, the antenna's structure and quality should be accurately designed.

Generally, a well-known antenna includes a dipole antenna, a monopole antenna, a patch antenna, a planar inverted-F antenna, a meander line antenna, an inverted-L antenna, a loop antenna, a spiral antenna, a spring antenna or the like. These antennas typically have larger size occupying larger space and increasing the size used in these electronic devices. However, these electronic devices are designed and developed to enable users easy to carry. Therefore, an approach to reduce the antenna size will be an issue for these electronic devices.

In addition, a conventional antenna has a second or third harmonic signal, or higher order harmonic signals. The high order harmonic signals will interfere with the transceiving and receiving signals, and will indirectly interfere with other wireless transmission devices and wireless communication devices. In the requirements of United States Federal Communications Commission (FCC), it sets the safety requirements for standard certification and provides intensity limitation to the high order harmonic signals of these antennas. For other countries, the same limitation in the safety requirements for standard certification is set. Due to the higher signal intensity of these high order harmonic signals, the electronic products using these antennas will not certified by the safety requirements for standard certification in the most countries. It causes these electronic products unable to be sold since they are not certified. Therefore, the approach to reduce these high order harmonic signals' intensity of the antenna becomes the problems to be overcome.

SUMMARY OF THE INVENTION

The present invention provides a small size structure antenna formed by micro-strip that uses annular shape to reduce the size.

The present invention provides a small antenna having annular shape which decreases the signal intensity of the high order harmonic signals, therefore the interference of high order harmonic signals with the transceiving and receiving signals can be avoided. Further the interference with other wireless transmission devices and wireless communication devices can also be eliminated.

Present invention provides an antenna structure which transmits and receives ultra wide frequency bandwidth antenna signals and operates in multi frequency bandwidth.

According to the embodiment of the present invention, an antenna structure is provided. The structure in the invention includes a transmission line forming an annular structure from outside to inside, and having a first end point and a second end point. The first end point electrically connects to a floating point, and the second end point electrically connects to a ground. A signal feeding point electrically connects to the transmission line and the distance of the second end point for two-thirds of the wavelength.

It is noted that the invention differs from other technologies, and provides an antenna structure with low intensity of high order harmonic signals and suitably operates in multi frequency bandwidth, in order to improve the technology.

Outlined above and the following detailed description and drawings are all in order to further illustration of the invention to achieve the intended purpose of the approach taken, and the effectiveness of the means. The purpose of the present invention and advantages will be descripting in the following specification.

DETAILED DESCRIPTION OF THE PREFERRED EMBODIMENTS

Figure 1:
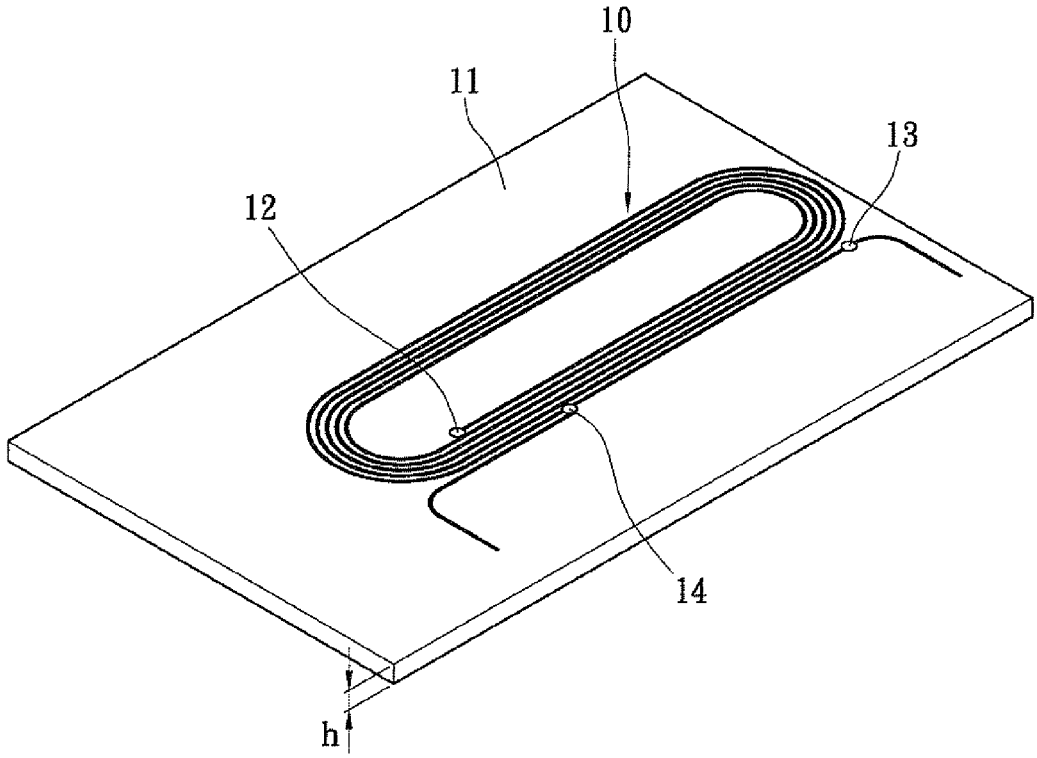
FIG. 1 is a schematic view illustrating the antenna structure of the present invention.

FIG. 1 is a schematic view illustrating the antenna structure of the present invention.

FIG. 1 is a schematic view illustrating the antenna structure 10 according to the present invention. The antenna structure 10 of the present invention is formed on a substrate 11, wherein the substrate 11 according to present embodiment is a standard Flame Retardant 4 (FR4) fiber glass reinforced plastics (FRP) substrate. In which the dielectric coefficient $\in r$ is 4.4, and the thickness h is 1.2 mm. According to present invention, the substrate 11 can be other specifications of FRP substrates or other specifications of substrates, the present invention is not limited by the specifications of the substrate 11.

In addition, the antenna structure 10 has two end points 12, 13, the first end point 12 as a floating point, and the second end point 13 is electrically connected to a ground. The antenna structure 10 of the present invention is formed in an annular shape, and the annular shape is formed from outside to inside by a transmission line. The annular shape can be a circular shape, a square shape, a triangle shape, an ellipse shape, or a loop composed by two semicircles and long straight lines shown in the FIG. 1. The annular shape structure has a plurality of laps. In addition, the antenna structure 10 has a signal feeding point 14 to feed the antenna signal.

Owing to the antenna structure 10 having an annular structure with a plurality of laps, the transmission line of the annular structure has the same line width and the same line spacing, hence, an inductor formed in the annular structure, and the value of the inductor can be easily adjusted by adjusting the line spacing and the number of laps of the transmission line.

The signal feeding point 14 of the antenna structure 10 as a connection point, and the signal feeding point 14 connects to the antenna structure 10 to feed the signal to the antenna structure 10. And, the signal feeding point 14 has a distance from the second end point 13 in two-thirds of the wavelength. That is, the signal feeding point 14 has a distance apart from the second end point 13 in two-thirds of wavelength ($2\lambda/3$). The antenna signal feeds from the signal feeding point 14 to the antenna structure 10, then, the antenna signal transfers to the first end point 12 and the second end point 13 at the same time, and transfers in a radial direction to the first end point 12 from outside to inside of the annular shape. In view of the signal feeding point 14 having a distance apart from the second end point 13 in the two-thirds of the wavelength. The antenna structure having better inductive reactance and capacitive reactance while the antenna signal transfers to the first end point 12.

According to the embodiment of the present invention, the preferred line width and line spacing of the antenna structure 10 are 0.2 mm. The antenna structure 10 has overall size occupied by length of 29.3 mm and width of 7.9 mm. However, the size of mentioned antenna structure 10 is a preferred practice case, and further the remaining size of the antenna structure 10 related to the preferred operation frequency, line length, line width, line spacing, and the numbers of laps of the annular shape, even related to the coefficient of the substrate 11 is provided. For example, when the different frequencies are applied, the line length will be adjusted accordingly. According to optical formula as $\lambda=CF$, expressed the relationship of wavelength ($\lambda$), the speed of light (C) and the frequency (F). For example, when a frequency is in 434 MHz, the wavelength is about 69 cm. In accordance with the shortest transmission line of the antenna required for a quarter-wavelength ($\lambda/4$), the transmission line length of the antenna need to about 17.27 cm. In addition, the size of the antenna structure 10 is in accordance with the parameters of the transmission line width, the line spacing, etc, this will not repeat again. Therefore, the antenna structure 10, the overall size only shares the preferred embodiment, the actual design parameters are still in accordance with the optimization of the design parameters. And, the parameters of the line length, line width, line spacing, and the size of the annular shape will be designed in accordance with the changes in the operation frequency bandwidth. The present invention is not limited by the design parameters of the antenna structure 10.

According to the present invention and the above description, while the antenna structure 10 operates in frequency 434 MHz, the shortest length of the transmission line of the antenna is about 17.27 cm. It is impossible to install such length of antenna in hand-held electronic devices. Therefore, present invention provides an antenna structure 10 having an annular structure, the antenna can be bent as an antenna structure 10 shown in the FIG. 1. Thus greatly narrowing the size of the antenna suits a variety of hand-held electronic devices. Even the length of the transmission line of the antenna structure 10 increases to be equal to the wavelength, or the length of the transmission line has a common multiple value by several frequency bandwidths to receive several frequency bandwidths at the same time. In accordance with the antenna structure 10 of the invention, the antenna will be smaller in order to reduce the size of area and volume of the antenna. In addition, the invention has better transceiving and receiving signals that can reduce the size of hand-held devices.

According to the embodiment of present invention, the antenna structure 10 may has the characteristics of multi-bandwidth operation and lower signal intensity in second harmonic signal, third harmonic signal and so on, thereby avoiding the interference with these high order harmonic signals, and also avoiding indirect interference with other wireless communication and wireless electronic devices. Therefore, the antenna structure 10 according to the present invention has excellent communication quality.

Figure 2:
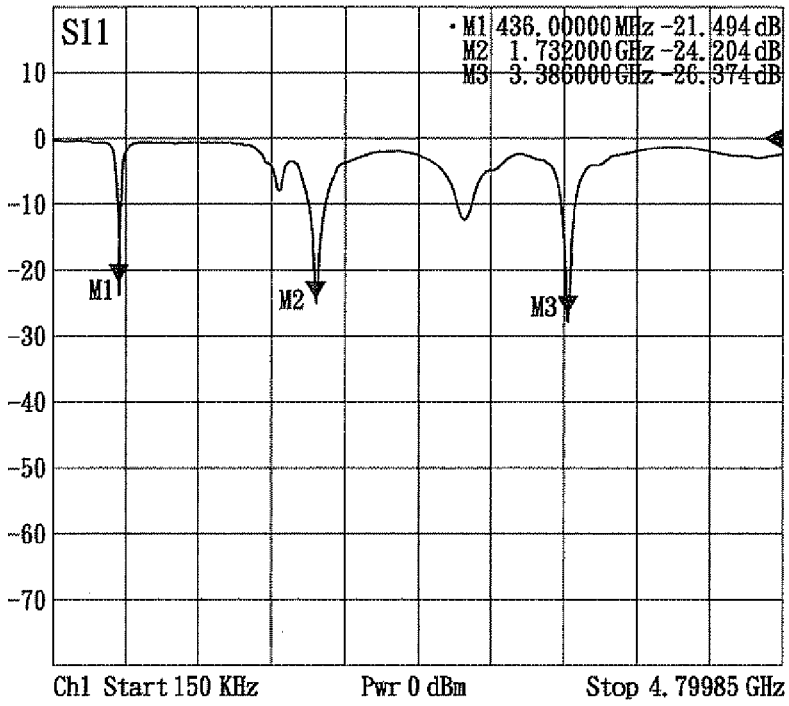
FIG. 2 is a diagram illustrating the measured return loss versus frequency according to the first embodiment of the present invention.

FIG. 2 is a diagram illustrating the measured return loss versus frequency according to the first embodiment of the present invention.

Figure 3:
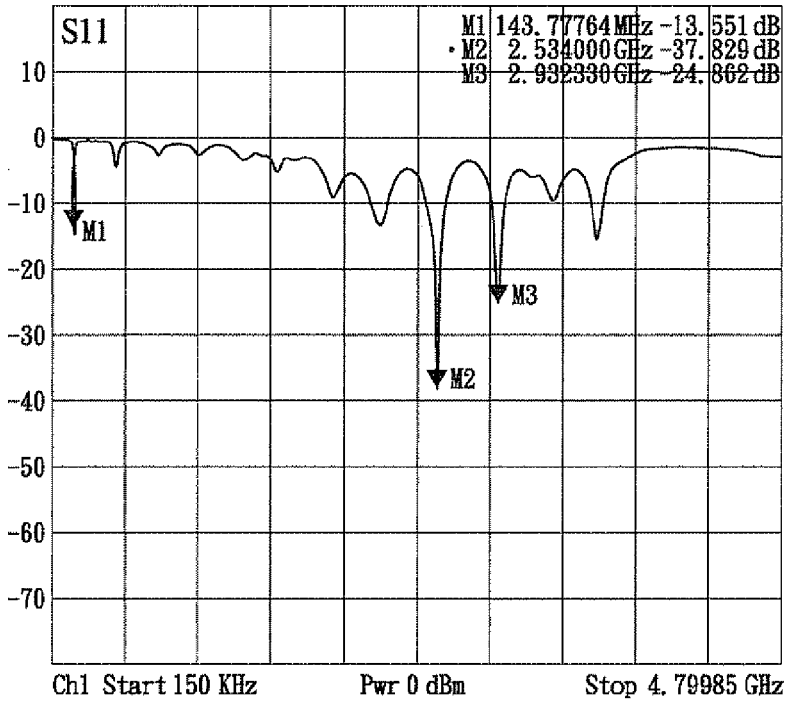
FIG. 3 is a diagram illustrating the measured return loss versus frequency according to the second embodiment of the present invention.

FIG. 3 is a diagram illustrating the measured return loss versus frequency according to the second embodiment of the present invention.

Figure 4:
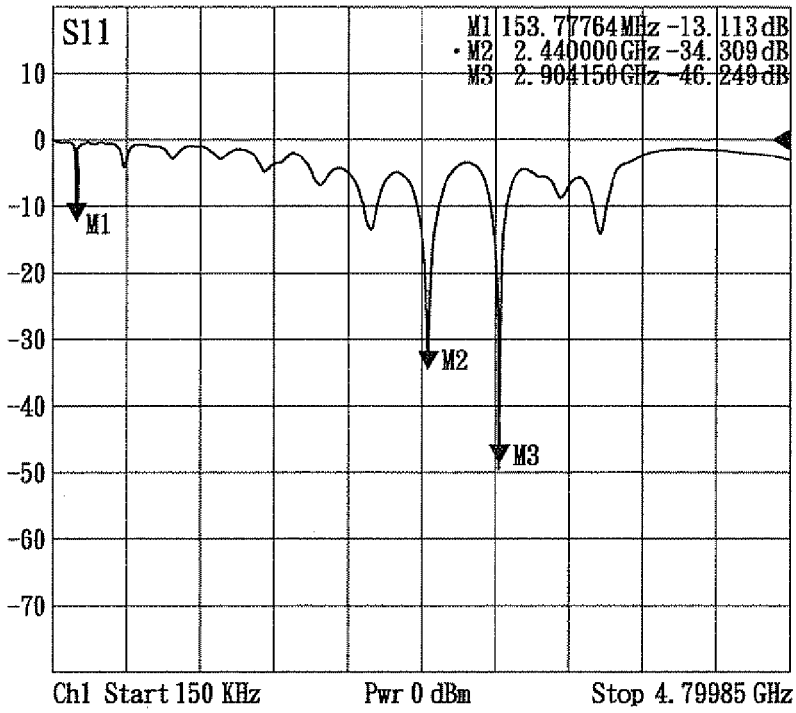
FIG. 4 is a diagram illustrating the measured return loss versus frequency according to the third embodiment of the present invention.

FIG. 4 is a diagram illustrating the measured return loss versus frequency according to the third embodiment of the present invention.

Figure 6:
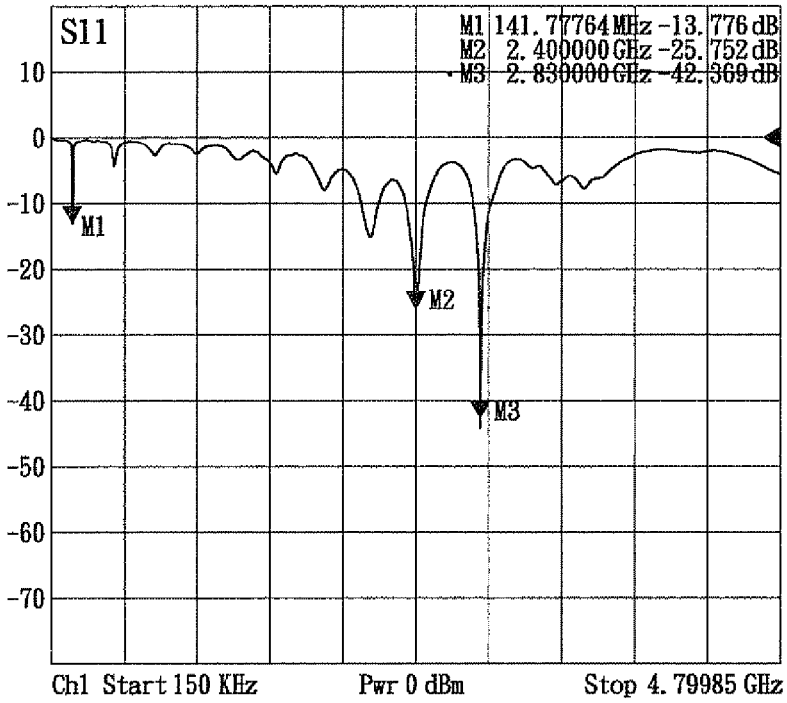
FIG. 6 is a diagram illustrating the measured return loss versus frequency according the fourth embodiment of the present invention.

FIG. 6 is a diagram illustrating the measured return loss versus frequency according the fourth embodiment of the present invention.

Please refer to FIG. 2, as FIG. 2 is a diagram illustrating the measured return loss versus frequency according to the first embodiment of the present invention. The antenna structure 10 according to the first embodiment of present invention has lowest return loss response in three frequencies 436 MHz, 1.73 GHz, 3.38 GHz, and the intensity of the return loss response lower than −20 dB. That is, the antenna structure 10 of present invention suitable operates in frequencies 436 MHz, 1.73 GHz, 3.38 GHz, and has good signal emission efficiency.

Please refer to FIG. 3, FIG. 4 and FIG. 6, as the FIG. 3, FIG. 4 and FIG. 6 illustrating the measured return loss response versus frequency according to the second, third and fourth embodiments of the present invention. As shown in FIG. 3, the antenna structure 10, according to the second embodiment of present invention, has lowest return loss in three frequency 143 MHz, 2.53 GHz, 2.93 GHz. As shown in FIG. 4, the antenna structure 10, according to the third embodiment of present invention, has lowest return loss response in three frequency 153 MHz, 2.44 GHz, 2.90 GHz. As shown in FIG. 6, the antenna structure 10, according to the fourth embodiment of present invention, has lowest return loss response in three frequency 141 MHz, 2.40 GHz, 2.83 GHz. Wherein, the second embodiment, the third embodiment and the fourth embodiment only slightly adjust the parameters of the first embodiment, as line length, line width, line spacing and laps, etc, and get other three groups of different frequencies and have return loss intensity lower than −20 dB. Thus, according to the present invention, it only slightly adjusts the parameters of the antenna structure 10, and the antenna structure 10 can be modified to operate in other three-frequency bandwidths to transceive and receive signals. In accordance with the first to fourth embodiments of the present invention, the antenna structure 10 of present invention has an ultra wide bandwidth to transceive or receive the signals, and it is only slightly modified the design parameters to adjust the transceiving and receiving frequency bandwidth. Therefore, the antenna structure 10 of the present invention is an ultra wide bandwidth antenna with flexible adjustment bandwidth to receive signal.

Figure 5:
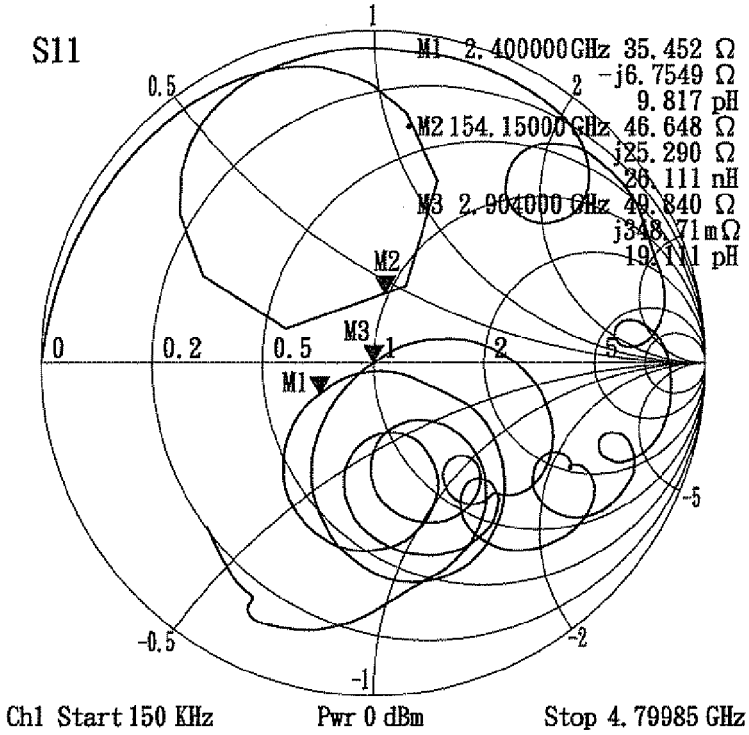
FIG. 5 is a Smith Chart diagram illustrating the third embodiment of the present invention.

FIG. 5 is a Smith Chart diagram illustrating the third embodiment of the present invention.

Figure 7:
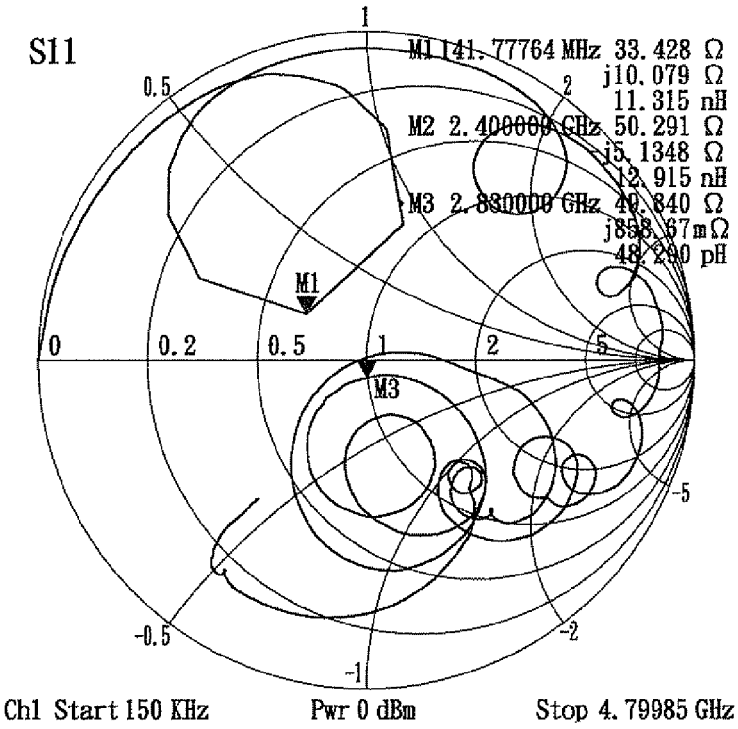
FIG. 7 is a Smith Chart diagram illustrating the fourth embodiment of the present invention.

FIG. 7 is a Smith Chart diagram illustrating the fourth embodiment of the present invention.

Please refer to FIG. 5 and FIG. 7, as the FIG. 5 being a Smith Chart diagram illustrating the third embodiment of the present invention. From the Smith Chart diagram shown in FIG. 5, the inductive reactance and the capacitive reactance can be read in three frequency 153 MHz, 2.44 MHz, 2.90 GHz of the antenna structure 10 of the present invention. Such as the Smith Chart diagram shown in FIG. 7 illustrates the fourth embodiment of the present invention. In which, the inductive reactance and the capacitive reactance can be read in three frequency 141 MHz, 2.40 GHz, 2.83 GHz of the antenna structure 10 of the present invention.

Figure 8:
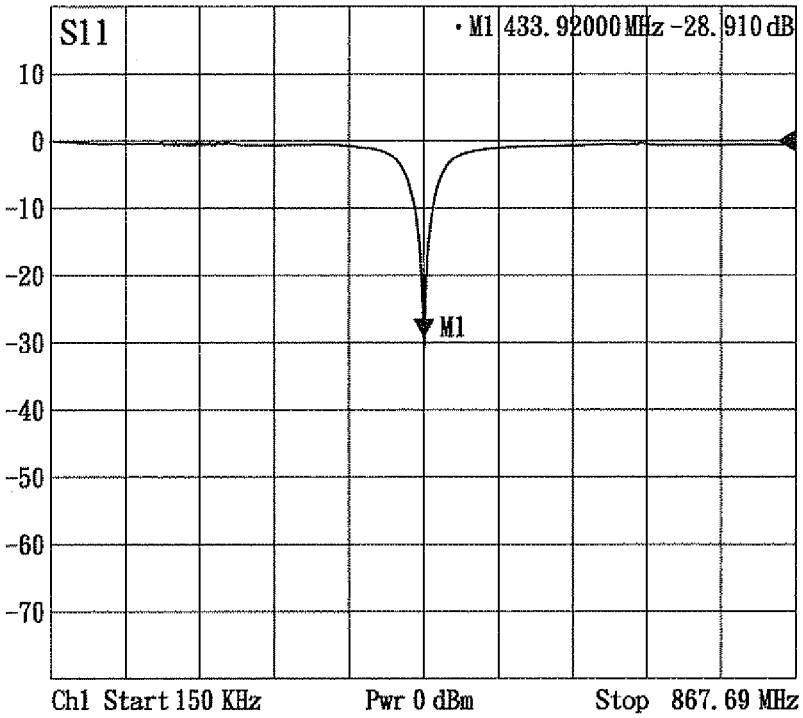
FIG. 8 is a diagram illustrating the measured return loss versus frequency according to the first embodiment of the present invention.

FIG. 8 is a diagram illustrating the measured return loss versus frequency according to the first embodiment of the present invention.

Figure 9:
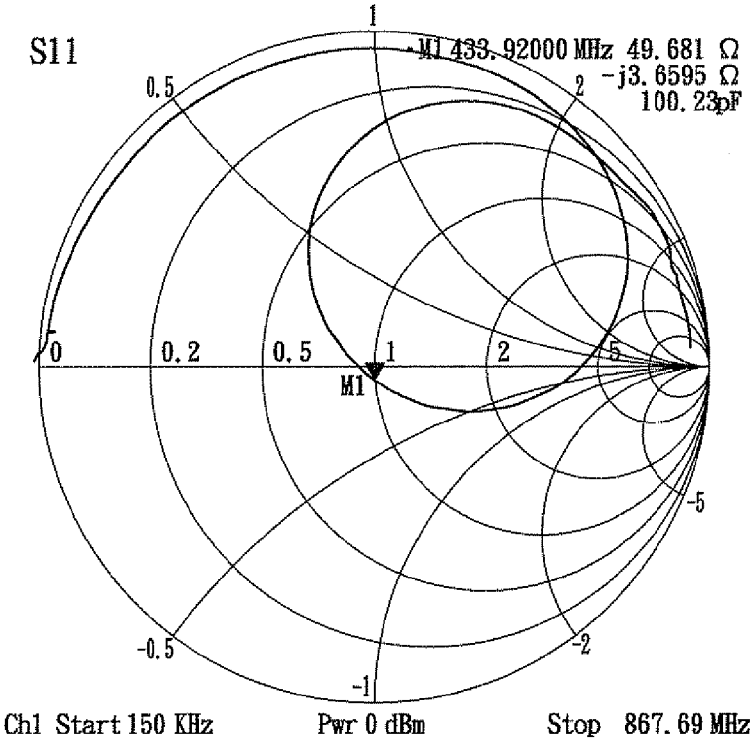
FIG. 9 is a Smith Chart diagram illustrating the first embodiment of the present invention.

FIG. 9 is a Smith Chart diagram illustrating the first embodiment of the present invention.

Please refer to FIG. 8 and FIG. 9. The FIG. 8 and FIG. 9 illustrating the measured plots scanned in a small frequency range (150 kHz to 867 kHz) of the first embodiment, it only shows the lowest frequency returning loss response in the first embodiment. FIG. 8 shows the antenna structure 10 in the first embodiment of the present invention has −28.9 dB and returns loss response in 433 MHz. FIG. 9 shows the inductive reactance and capacitance reactance of the antenna structure 10 of the first embodiment.

Figure 10:
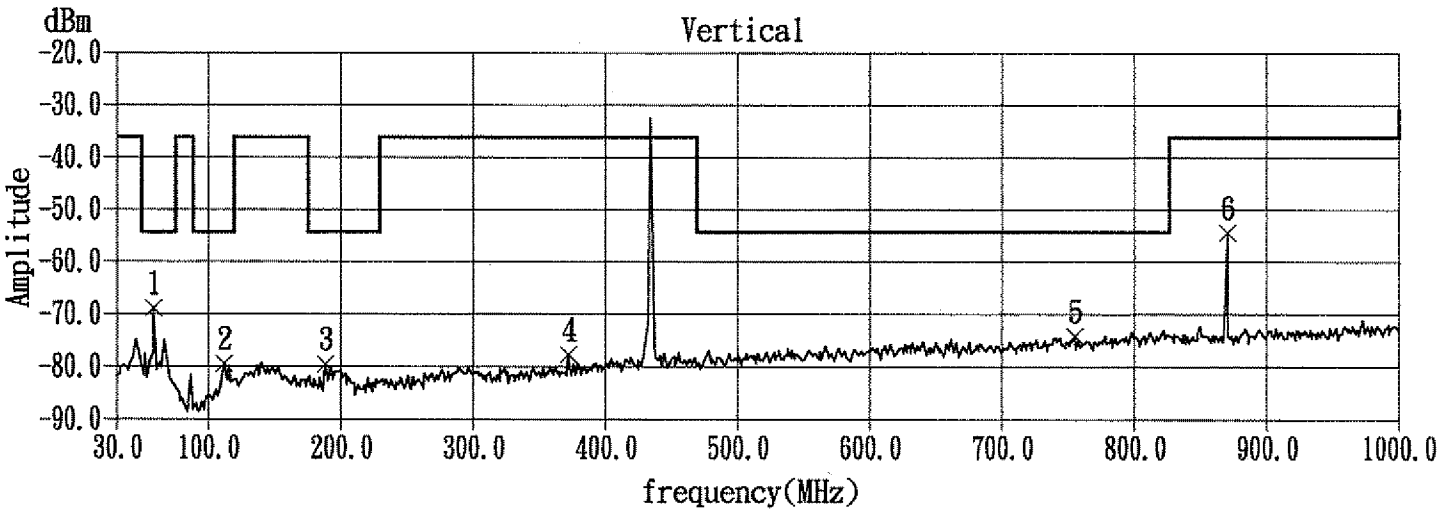
FIG. 10 is a diagram illustrating the measured electromagnetic interference in vertical direction according to the first embodiment of the present invention.

FIG. 10 is a diagram illustrating the measured electromagnetic interference in vertical direction according to the first embodiment of the present invention.

Figure 11:
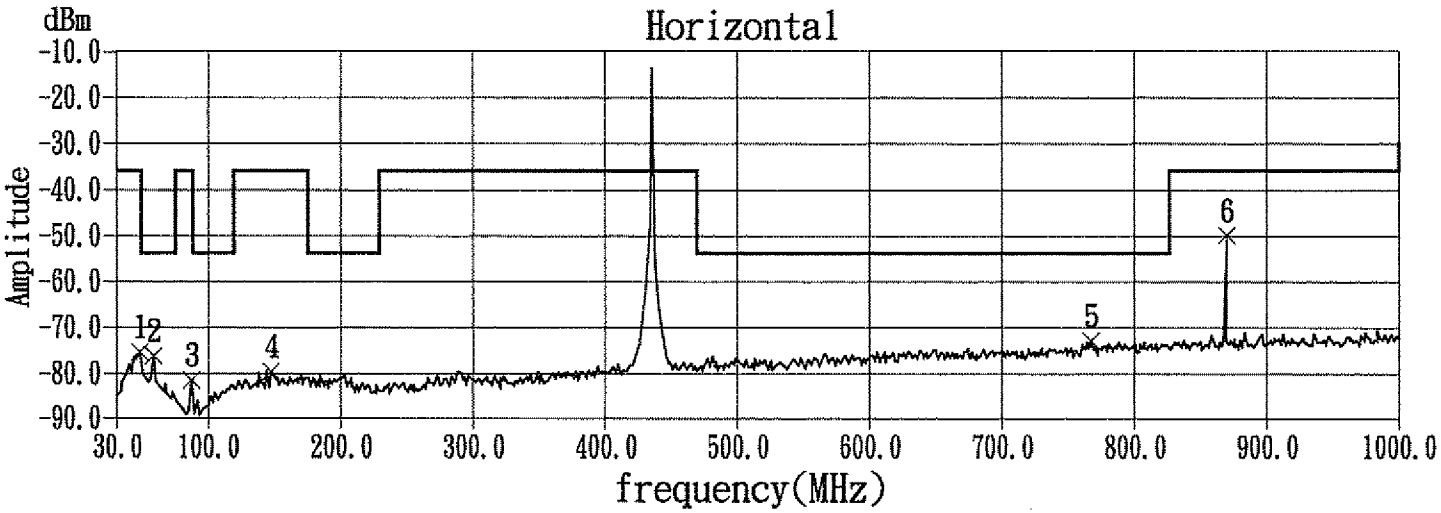
FIG. 11 is a diagram illustrating the measured electromagnetic interference in horizontal direction according to the first embodiment of the present invention.

FIG. 11 is a diagram illustrating the measured electromagnetic interference in horizontal direction according to the first embodiment of the present invention.

Please refer to FIG. 10 and FIG. 11. FIG. 10 and FIG. 11 illustrating the measured electromagnetic interference in vertical direction and horizontal direction according to the first embodiment of the present invention. A black line shown in the FIG. 10 and FIG. 11 indicates the intensity limitation of the high order harmonic signals in the safety requirements for standard certification. Since only the main peak signal intensity is higher then the limitation, other high order harmonic signals should have lower intensity than the black line of the limitation. Referring to the antenna structure 10 shown in the FIG. 1, the main peak signal should transceive higher intensity, so that the main peak signal intensity can be higher than the intensity limitation of the safety requirement for standard certification. According to present invention, the antenna structure 10 shown in the FIG. 1 operates at the frequency 433 MHz, and the main peak signal at the frequency 433.92 MHz shown in FIG. 10 and FIG. 11 has higher intensity than the limitation of the safety requirement for standard certification. Since several high order harmonic signals are beside the main peak signal at the frequency 433 MHz, these high order harmonic signals have lower signal intensity than −50 dBm, fitting in with the limitation of the safety requirement for standard certification. That is, the antenna structure 10 of the present invention can effectively compress the signal intensity of high order harmonic signals, and avoid the transceiving and receiving signals interference with high order harmonic signals. The indirect interference with other wireless transmission and wireless communications electronic devices can be avoided, and the health of users harmed by the electromagnetic wave can also avoided.

Figure 12:
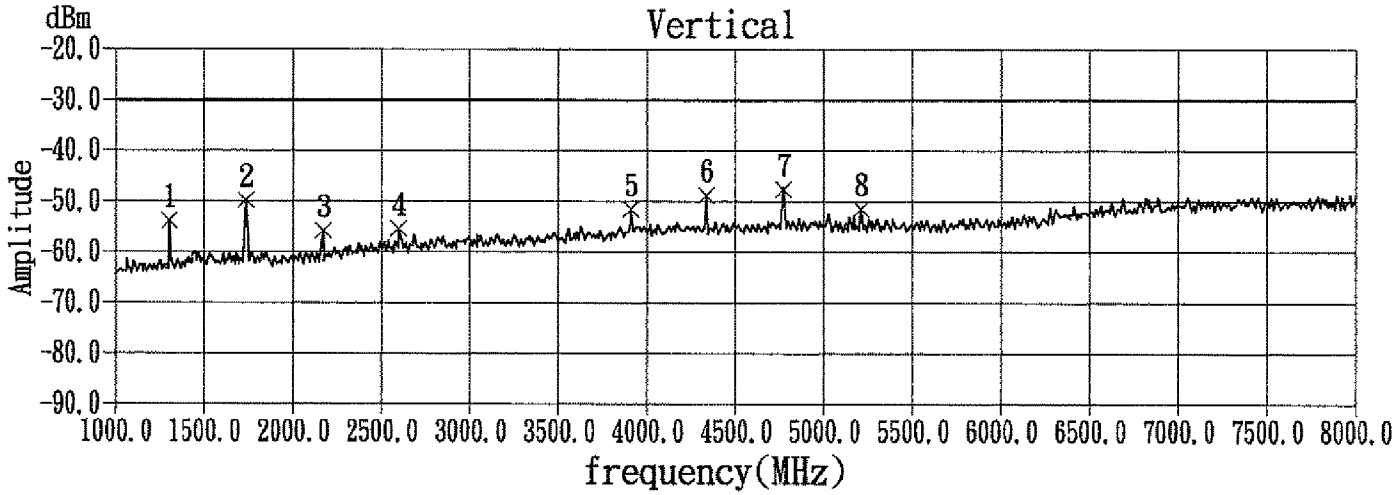
FIG. 12 is a diagram illustrating the measured electromagnetic interference of the high order harmonics in vertical direction according to the first embodiment of the present invention.

FIG. 12 is a diagram illustrating the measured electromagnetic interference of the high order harmonics in vertical direction according to the first embodiment of the present invention.

Figure 13:
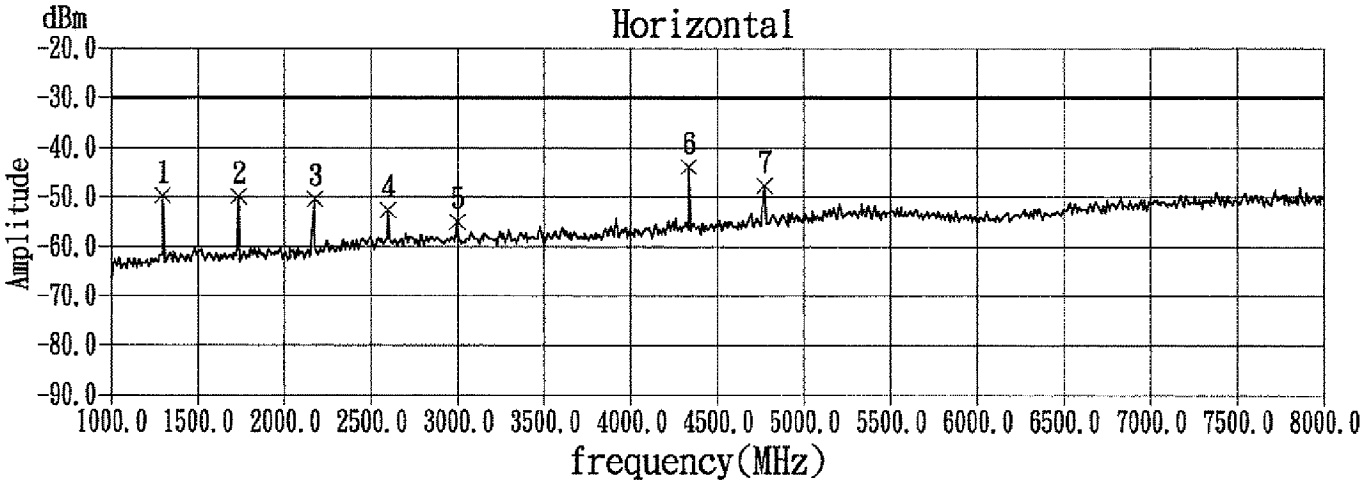
FIG. 13 is a diagram illustrating the measured electromagnetic interference of the high order harmonics in horizontal direction according to the first embodiment of the present invention.

FIG. 13 is a diagram illustrating the measured electromagnetic interference of the high order harmonics in horizontal direction according to the first embodiment of the present invention.

Please refer to FIG. 12 and FIG. 13. FIG. 12 and FIG. 13 illustrating the measured electromagnetic interference in a vertical direction and a horizontal direction according to the first embodiment of the present invention. The FIG. 12 and FIG. 13 show the high order harmonic signals having the signal intensity lower than −30 dBm of the safety requirement for standard certification. The antenna structure 10 shown in the FIG. 1 is ranged from 100 KHz to 8000 MHz. Therefore, it proves the antenna structure 10 of the present invention can effectively compress the signal intensity of the high order harmonic signals, and avoid the transceiving and receiving signal from interference with high order harmonic signals. Furthermore, the indirect interference with other wireless transmission and wireless communications electronic devices can be avoided. The health of users harmed by the electromagnetic wave can be avoided when these electronic devices with the antenna structure 10 shown in the FIG. 1 is used.

As the above mentioned, only descript the detail description and figures of the embodiments of the present invention, not to limit the present invention scope, the scope of the present invention should covered by the following claims, and anyone in the art or any easily obvious changes or modifies which all covered by the claims of the present invention.

What is claimed is:

1. An antenna structure, comprising:

a transmission line forming an annular structure from outside to inside, and having a first end point and a second end point, wherein the first end point is a floating point, and the second end point electrically connects to a ground, wherein the line width of the transmission line is 0.2 mm, wherein the transmission line has at least one semicircle and a long straight line; and a signal feeding point electrically connected to the transmission line, wherein the distance from the signal feeding point to the second end point is two-thirds of the wavelength.

2. The antenna structure of claim 1, wherein the signal feeding point feeds an antenna signal to the antenna structure.

3. The antenna structure of claim 1, further comprising a substrate, and the antenna structure is formed on the substrate.

4. The antenna structure of claim 3, wherein the substrate is an FR4 substrate.

5. The antenna structure of claim 1, wherein the annular structure is a circular shape, a square shape, a triangle shape, an ellipse shape or an loop shape.

6. The antenna structure of claim 1, wherein the annular structure forms an inductor.

7. The antenna structure of claim 1, wherein the annular structure has a plurality of laps.

* * * * *